US007824242B2

(12) United States Patent
Perman et al.

(10) Patent No.: US 7,824,242 B2
(45) Date of Patent: Nov. 2, 2010

(54) ASYMMETRICAL UNDERWIRE ARRANGEMENT

(75) Inventors: Kathy Perman, Rowayton, CT (US); Ann Armstrong, Brooklyn, NY (US); Nathalie Martinet, Verona, NJ (US)

(73) Assignee: Victoria's Secret Stores Brand Management, Inc., Reynoldsburg, OH (US)

( * ) Notice: Subject to any disclaimer, the term of this patent is extended or adjusted under 35 U.S.C. 154(b) by 372 days.

(21) Appl. No.: 12/052,368

(22) Filed: Mar. 20, 2008

(65) Prior Publication Data

US 2009/0239444 A1 Sep. 24, 2009

(51) Int. Cl.
*A41C 3/14* (2006.01)

(52) U.S. Cl. ..... 450/41; 450/52

(58) Field of Classification Search ..... 450/41, 450/45–48, 51, 52; 2/255–206, 260.1, 261, 2/264

See application file for complete search history.

(56) References Cited

U.S. PATENT DOCUMENTS

| | | | | | |
|---|---|---|---|---|---|
| 2,613,362 | A * | 10/1952 | Hirsch | 2/151 |
| 5,401,203 | A * | 3/1995 | Fildan | 450/41 |
| 5,697,830 | A * | 12/1997 | White | 450/36 |
| 6,746,306 | B2 * | 6/2004 | Brothers | 450/41 |
| 6,761,613 | B2 * | 7/2004 | Utaka | 450/41 |
| 6,953,380 | B2 * | 10/2005 | Brothers | 450/41 |
| 2009/0042478 | A1 * | 2/2009 | McKee et al. | 450/52 |

* cited by examiner

*Primary Examiner*—Gloria Hale
(74) *Attorney, Agent, or Firm*—Colucci & Umans

(57) ABSTRACT

In a bra having a pair of cups each with a central area and a lower perimeter area, the improvement of an asymmetric underwire arrangement including one shorter curved underwire extending in the lower perimeter area of one cup, and one longer curved underwire extending in the lower perimeter area of the other cup, the underwires each having inner ends that are adjacent each other at a central location where the pair of cups meet, and outer ends that are spaced away from each other, the inner end of the longer underwire extending further into the central location than that of the shorter underwire for enhancing cleavage for a woman wearing the bra.

21 Claims, 1 Drawing Sheet

ASYMMETRICAL UNDERWIRE ARRANGEMENT

FIELD AND BACKGROUND OF THE INVENTION

The present invention relates generally to the field of bras, and in particular to the new and usefully asymmetrical underwire arrangement for bras.

Underwires that partly encircle the lower perimeter area of each cup of a bra, have been used for many years, and variations of wire materials, cross-sectional shapes for the wires, tip covers, encasing tubes and the like, are taught by many patents.

Universally, however, the left and right underwires or the left and right parts of a one-piece underwire, have been symmetrical. The perceived need for this symmetry is intuitive, in that the universally desired symmetry of breast size and shape would appear to require symmetry in the underwire design as well.

SUMMARY OF THE INVENTION

The inventors have discovered that an asymmetrical underwire design enhances the appearance of the breasts and creates an attractive enhanced cleavage that forms a "kissing" center between the breasts. The invention allows the breast tissues to be as close as possible to each other and thus maximizes the amount of cleavage without excess bulk in the bra cups.

The inventors have also found that the advantageous effect of the asymmetrical underwires are even further enhances by including air pockets in the central cup areas above the underwires.

Accordingly it is an object of the present invention to provide, in a bra having a pair of cups each with a central area and a lower perimeter area, an improvement comprising an asymmetric underwire arrangement including one relatively shorter curved underwire extending in the lower perimeter area of one of the cups, and one relatively longer curved underwire extending in the lower perimeter area of the other of the cups, the underwires each having inner ends that are adjacent each other at a central location where the pair of cups meet, and outer ends that are spaced away from each other, the inner end of the longer underwire extending further into the central location than the inner end of the shorter underwire, preferably vertically in the central location, for enhancing cleavage for a woman wearing the bra.

Another object of the invention is to provide a bra subassembly, namely at least parts of the cups of a bra, that comprise a pair of cups each with a central area with an air containing pocket and a lower perimeter area, and an asymmetric underwire arrangement including one relatively shorter curved underwire extending in the lower perimeter area of one of the cups, and one relatively longer curved underwire extending in the lower perimeter area of the other of the cups, the underwires each having inner ends that are adjacent each other and positively held at the central location where the pair of cups meet, preferably by a substantially triangular stabilizer piece of fabric that captures the inner ends, and outer ends that are spaced away from each other, the inner end of the longer underwire extending further into the central location than the inner end of the shorter underwire for enhancing cleavage for a woman wearing the bra.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
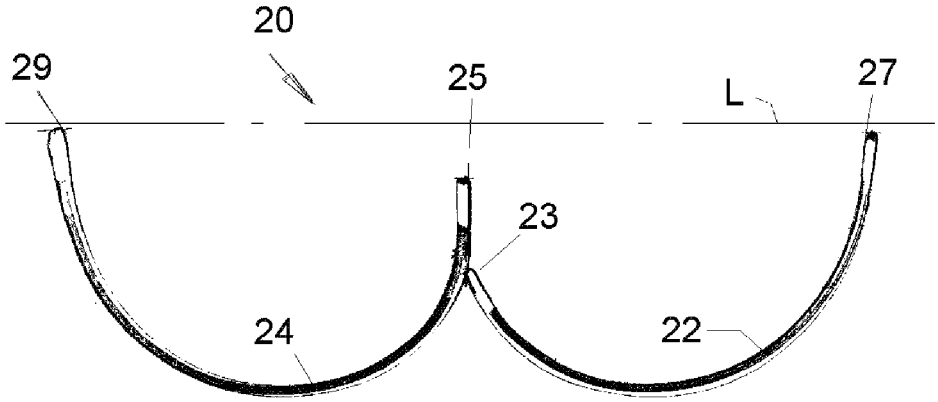
FIG. 1 is a front elevational view of the asymmetrical underwire arrangement of the invention.
Figure 3:
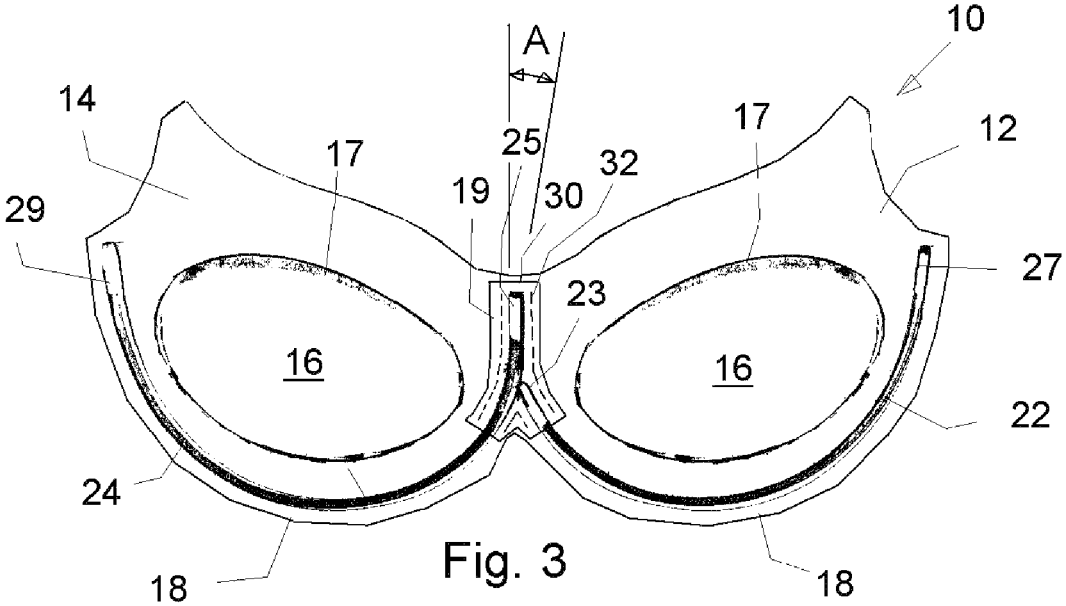
FIG. 3 is a front elevational view of the asymmetrical underwire arrangement of FIG. 1, in a bra cup subassembly of the invention.

Referring now to the drawings, in which like reference numerals are used to refer to the same or similar elements, FIGS. 1 and 3 illustrate, for a bra subassembly 10 (FIG. 3) having a pair of cups 12 and 14, each with a central area 16, and a lower perimeter area 18, an asymmetric underwire arrangement 20 (FIG. 1) including one relatively shorter curved underwire 22 extending in the lower perimeter area 18 of one of the cups, and one relatively longer curved underwire 24 extending in the lower perimeter area 18 of the other of the cups.

The underwires each have an inner end 23 and 25 respectively, that are adjacent each other at a central location 19 of the bra subassembly, where the pair of cups meet, and outer ends 27 and 29 respectively, that are spaced away from each other. The inner end 25 of the longer underwire 24 extends further into the central location 19 than the inner end 23 of the shorter underwire 22 for enhancing cleavage for a woman wearing the bra. The inner end 25 of the longer underwire preferably extends substantially vertically (i.e. about zero to about 20 degrees to the vertical) in the central area 19 and alone the center line of the bra. Inner end 25 is held in correct relationship with the inner end 23 of the shorter underwire 22 by a substantially triangular fabric stabilizer panel 30, stitched at seams 32, or otherwise fixed around the inner ends to the rest of the subassembly fabric, as shown in FIG. 3. The inner end 23 of shorter underwire 22 also extends under the stabilizer 30 but is at an angle of about 20 degrees (i.e. about 5 to about 40 or preferably about 10 to about 30 degrees) to the vertical, at the location where the inner end 23 meets or almost meets the longer underwire 24, below the inner end 25 of the longer underwire.

Figure 2:
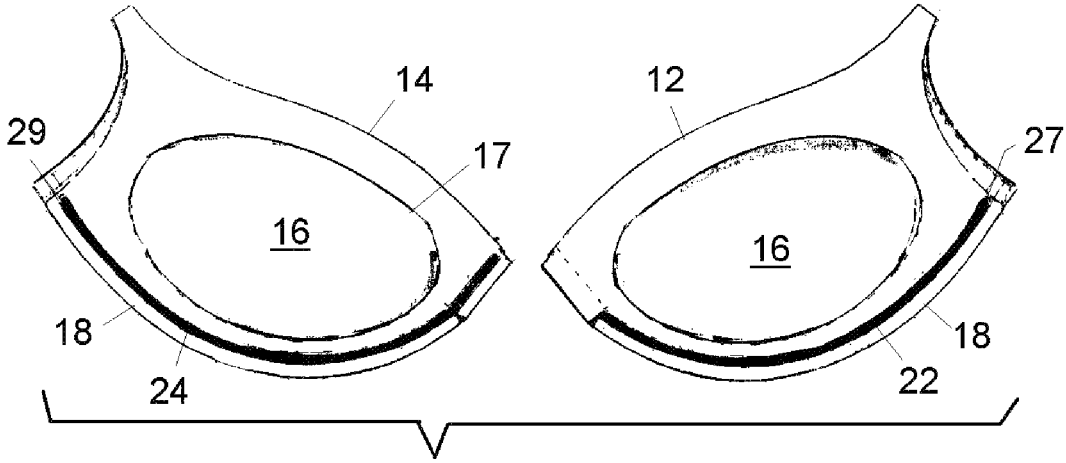
FIG. 2 is a front elevational and exploded view of a second embodiment of the asymmetrical underwire arrangement of the invention in a bra cup subassembly of the invention.

As shown in FIG. 2, the bra subassembly 10 is made of the cups 12 and 14 that are initially separate and each provided in the lower perimeter area 18 with their respective shorter (e.g. left to the woman wearing a bra containing the invention) and longer (e.g. right) underwires 22 and 24.

Each underwire 22 and 24 is of any currently known or to-be-discovered construction, such as flat metal or plastic wires, wires in fabric tubes, wires with end caps of various types, and other underwire designs that are known by the person of ordinary skill in this art.

The inventors have found that the asymmetrical design effectively and surprisingly enhances the appearance of the breasts and creates an attractive enhanced cleavage that forms a "kissing" center between the breasts. By making the underwires of different lengths and, in effect, crossing their paths at the center location of the bra between the cups, the tissue of each breast is closer to the other and this maximizes the amount of cleavage without excess bulk in the bra cups.

To further enhance cleavage without adding bulk, an air containing pocket 17 is included in the central area 16 of each cup, each pocket being spaced above the underwires and the perimeter areas. Each pocket is made of air tight plastic and is a flat oval shape that is only partly filled with air to provide some soft volume, but not a rigid balloon effect. Accordingly each plastic pocket is only filled to about 5 to 25 percent of its total volume and may contain air alone, or air with light flake, granular or gel particles included.

The inventors have found that the improvement is best if the ratio of the length of the shorter underwire 22 to the length of the longer underwire 24 is about 1:1.1 to 1:1.3, and the inner end 23 of the shorter underwire either engages or is very near the longer underwire 24 at a location along the longer underwire that is spaced from the inner end 25 of the longer underwire. This spacing can be on the order of ¾ to 2 inches (preferable ⅞ to 1⅛ inches), which represents the length of longer underwire that extends beyond the inner end of the shorter underwire in the central bra location 19, extending at an angle of about zero to about 60 degrees. In certain embodiments, the longer wire may extend at an angle of about zero to about 50 degrees. In other embodiments, the longer wire may extend at an angle of about zero to about 30 degrees. Thus for a shorter underwire 22 of 7 inches length along its curve, the longer underwire can be from about 7.7 to 9.0 inches long, with a preferred length of 8½ inches being found to work well.

The strip of cup material under each underwire in the perimeter area 18 was also selected to be about ¼ inch wide to encase each underwire firmly in each cup. The outer ends 27 and 29 of the shorter and longer underwires also should lie on the same horizontal line L in FIG. 1 for example, when the bra extends horizontally.

As shown in FIG. 3, the portion of the longer underwire 24, that extends beyond the inner end 23 of the shorter underwire 22, extends substantially vertically or may be at an angle A of about zero to about 10 degrees to the vertical.

The cups 12 and 14 are fixed, e.g. by sewing or fusing, to each other in central location 19 as in FIG. 3. The completed bra of the invention will also include the usual back and shoulder straps (not shown), or the invention can be incorporated into other garments that contain a breast supporting, bra-like structure, such as bathing suits, camisoles, blouses or tops, dresses and the like.

While a specific embodiment of the invention has been shown and described in detail to illustrate the application of the principles of the invention, it will be understood that the invention may be embodied otherwise without departing from such principles.

What is claimed is:

1. In a bra having a pair of cups each with a central area and a lower perimeter area, said central area being located between the cups the improvement comprising an asymmetric underwire arrangement including one relatively shorter curved underwire extending in the lower perimeter area of one of the cups, and one relatively longer curved underwire extending in the lower perimeter area of the other of the cups, the underwires each having inner ends that are adjacent each other at a central location where the pair of cups meet, and outer ends that are spaced away from each other, the inner end of the longer underwire extending further into the central area than the inner end of the shorter underwire for enhancing cleavage for a woman wearing the bra.

2. In the bra of claim 1, the improvement comprising the ratio of the length of the shorter underwire to the length of the longer underwire being about 1:1.1 to 1:1.3.

3. In the bra of claim 1, the improvement including an air containing pocket in the central area of each cup, each pocket being spaced above each respective underwire.

4. In the bra of claim 1, the improvement wherein the inner end of the shorter underwire is closest to the longer underwire at a location along the longer underwire that is spaced from the inner end of the longer underwire so that the longer underwire extends beyond the shorter underwire substantially vertically and centrally in the central area, the improvement including a substantially triangular stabilizer fixed to the bra for fixing the relative positions of the inner ends to the central area.

5. In the bra of claim 1, the improvement comprising the ratio of the length of the shorter underwire to the length of the longer underwire being about 1:1.1 to 1:1.3, the improvement including a substantially triangular stabilizer fixed to the bra for fixing the relative positions of the inner ends to the central area, and an air containing pocket in the central area of each cup, each pocket being spaced above the underwire and the inner end of the shorter underwire being nearest the longer underwire at a location along the longer underwire that is spaced from the inner end of the longer underwire.

6. In the bra of claim 1, the improvement wherein the outer ends of the shorter and longer underwires lie on the same horizontal line when the bra extends horizontally, the inner end of the shorter underwire being lower than the inner end of the longer underwire.

7. In the bra of claim 1, the improvement comprising the ratio of the length of the shorter underwire to the length of the longer underwire being about 1:1.1 to 1:1.3, the improvement including an air containing pocket in the central area of each cup, each pocket being spaced above the underwire and the inner end of the shorter underwire engaging the longer underwire at a location along the longer underwire that is spaced from the inner end of the longer underwire, the outer ends of the shorter and longer underwires lying on the same horizontal line when the bra extends horizontally.

8. In the bra of claim 1, the improvement comprising the ratio of the length of the shorter underwire to the length of the longer underwire being about 1:1.1 to 1:1.3, the inner end of the shorter underwire engaging the longer underwire at a location along the longer underwire that is spaced from the inner end of the longer underwire, the outer ends of the shorter and longer underwires lying on the same horizontal line when the bra extends horizontally.

9. In the bra of claim 1, the improvement comprising the inner end of the shorter underwire being near the longer underwire at a location along the longer underwire that is spaced from the inner end of the longer underwire, the outer ends of the shorter and longer underwires lying on the same horizontal line when the bra extends horizontally, a portion of the longer underwire that extends beyond the inner end of the shorter underwire, extending at an angle of about zero to about 10 degrees.

10. In the bra of claim 1, the improvement comprising the inner end of the shorter underwire being near the longer underwire at a location along the longer underwire that is spaced from the inner end of the longer underwire, the outer ends of the shorter and longer underwires lying on the same horizontal line when the bra extends horizontally, a portion of the longer underwire that extends beyond the inner end of the shorter underwire, extending at an angle of about zero to about 10 degrees, and a substantially triangular stabilizer fixed to the bra for fixing the relative positions of the inner ends to the central area.

11. In the bra of claim 1, the improvement comprising the ratio of the length of the shorter underwire to the length of the longer underwire being about 1:1.1 to 1:1.3, the shorter underwire at its inner end extending along a line that intersects the longer underwire at a location along the longer underwire that is spaced from the inner end of the longer underwire, the outer ends of the shorter and longer underwires lying on the same horizontal line when the bra extends horizontally, a portion of the longer underwire extending beyond the inner end of the shorter underwire, extending at an angle of about zero to about 60 degrees.

12. A bra subassembly comprising: a pair of cups each with a central area with an air containing pocket and a lower perimeter area, an asymmetric underwire arrangement including one relatively shorter curved underwire extending in the lower perimeter area of one of the cups, and one relatively longer curved underwire extending in the lower perimeter area of the other of the cups, the underwires each having inner ends that are adjacent each other at a central area where the pair of cups meet, and outer ends that are spaced away from each other, the inner end of the longer underwire extending substantially vertically and centrally and further into the central area than the inner end of the shorter underwire for enhancing cleavage for a woman wearing the bra, and a substantially triangular stabilizer fixed to the bra for fixing the relative positions of the inner ends to the central area.

13. The bra subassembly of claim 12, wherein the ratio of the length of the shorter underwire to the length of the longer underwire is about 1:1.1 to 1:1.3.

14. The bra subassembly of claim 12, wherein the inner end of the shorter underwire engages the longer underwire at a location along the longer underwire that is spaced from the inner end of the longer underwire.

15. The bra subassembly of claim 12, comprising the ratio of the length of the shorter underwire to the length of the longer underwire being about 1:1.1 to 1:1.3, the inner end of the shorter underwire engaging the longer underwire at a location along the longer underwire that is spaced from the inner end of the longer underwire.

16. The bra subassembly of claim 12, comprising the ratio of the length of the shorter underwire to the length of the longer underwire being about 1:1.1 to 1:1.3, the inner end of the shorter underwire being near the longer underwire at a location along the longer underwire that is spaced from the inner end of the longer underwire, the outer ends of the shorter and longer underwires lying on the same horizontal line when the bra extends horizontally.

17. The bra subassembly of claim 12, wherein the inner end of the shorter underwire is near the longer underwire at a location along the longer underwire that is spaced from the inner end of the longer underwire, the outer ends of the shorter and longer underwires lying on the same horizontal line when the bra extends horizontally, a portion of the longer underwire that extends beyond the inner end of the shorter underwire, extending at an angle of about zero to about 10 degrees.

18. The bra subassembly of claim 12, wherein the inner end of the shorter underwire is near the longer underwire at a location along the longer underwire that is spaced from the inner end of the longer underwire, the outer ends of the shorter and longer underwires lying on the same horizontal line when the bra extends horizontally, a portion of the longer underwire that extends beyond the inner end of the shorter underwire, extending at an angle of about zero to about 50 degrees.

19. The bra subassembly of claim 12, comprising the ratio of the length of the shorter underwire to the length of the longer underwire being about 1:1.1 to 1:1.3, the shorter underwire at its inner end extending along a line that intersects the longer underwire at a location along the longer underwire that is spaced from the inner end of the longer underwire, the outer ends of the shorter and longer underwires lying on the same horizontal line when the bra extends horizontally, a portion of the longer underwire extending beyond the inner end of the shorter underwire, extending at an angle of about zero to about 10 degrees.

20. In a bra having a pair of cups each with a central area and a lower perimeter area, the improvement comprising an asymmetric underwire arrangement including one relatively shorter curved underwire extending in the lower perimeter area of one of the cups, and one relatively longer curved underwire extending in the lower perimeter area of the other of the cups, the underwires each having inner ends that are adjacent each other at a central area where the pair of cups meet, and outer ends that are spaced away from each other, the inner end of the longer underwire extending further into the central area than the inner end of the shorter underwire for enhancing cleavage for a woman wearing the bra, the ratio of the length of the shorter underwire to the length of the longer underwire being about 1:1.1 to 1:1.3, the shorter underwire at its inner end extending along a line that intersects the longer underwire at a location along the longer underwire that is spaced from the inner end of the longer underwire, the outer ends of the shorter and longer underwires lying on the same horizontal line when the bra extends horizontally, a portion of the longer underwire extending beyond the inner end of the shorter underwire, extending at an angle of about zero to about 60 degrees, the inner end of the shorter underwire extending at an angle of about 5 to 40 degrees to the vertical, and a substantially triangular stabilizer fixed to the bra for fixing the relative positions of the inner ends to the central area.

21. The bra subassembly of claim 12, wherein the inner end of the shorter underwire is near the longer underwire at a location along the longer underwire that is spaced from the inner end of the longer underwire, the outer ends of the shorter and longer underwires lying on the same horizontal line when the bra extends horizontally, a portion of the longer underwire that extends beyond the inner end of the shorter underwire, extending at an angle of about zero to about 30 degrees.

* * * * *